US005234521A

United States Patent [19]

Groshens et al.

[11] Patent Number: 5,234,521

[45] Date of Patent: Aug. 10, 1993

[54] METHOD AND APPARATUS FOR MANUFACTURING A TEXTILE BASED HEAT-BONDING PRODUCT

[75] Inventors: Pierre Groshens, Peronne; Bernard Demoulin, Barleux, both of France

[73] Assignee: Lainiere De Picardie, Peronne, France

[21] Appl. No.: 464,108

[22] Filed: Jan. 12, 1990

[30] Foreign Application Priority Data

Jan. 13, 1989 [FR] France ..... 89 00387

[51] Int. Cl.[5] ..... B32B 31/00

[52] U.S. Cl. ..... 156/230; 156/231; 156/290; 118/212; 427/148

[58] Field of Search ..... 101/153, 154, 170; 118/212, 211, 216; 156/231, 240, 291, 235, 230, 290; 427/146, 148, 150

[56] References Cited

U.S. PATENT DOCUMENTS

| | | | |
|---|---|---|---|
| 2,897,109 | 7/1959 | Voigtman | 156/244.27 |
| 3,814,052 | 6/1974 | Caratsch | 118/212 X |
| 4,139,613 | 2/1979 | Hefele | 118/212 X |
| 4,216,252 | 8/1980 | Moeller | 101/170 X |
| 4,292,104 | 9/1981 | Heimbach et al. | 156/235 |
| 4,294,650 | 10/1981 | Werthmann | 156/231 X |
| 4,671,205 | 6/1987 | Billeter | 118/406 |

FOREIGN PATENT DOCUMENTS

| | | | |
|---|---|---|---|
| 268545 | 9/1950 | France | 118/212 |
| 441839 | 11/1948 | Italy | 101/170 |

*Primary Examiner*—David A. Simmons
*Assistant Examiner*—James J. Engel, Jr.
*Attorney, Agent, or Firm*—Mason, Fenwick & Lawrence

[57] ABSTRACT

The present invention provides a method of manufacturing a textile based heat-bonding product by hot spot coating wherein the heat bonding polymer is deposited in the form of spots on a transfer mat by a photogravure cylinder and the heat-bonding polymer spots are then placed in contact with the textile supporting base for transfer thereto.

8 Claims, 1 Drawing Sheet

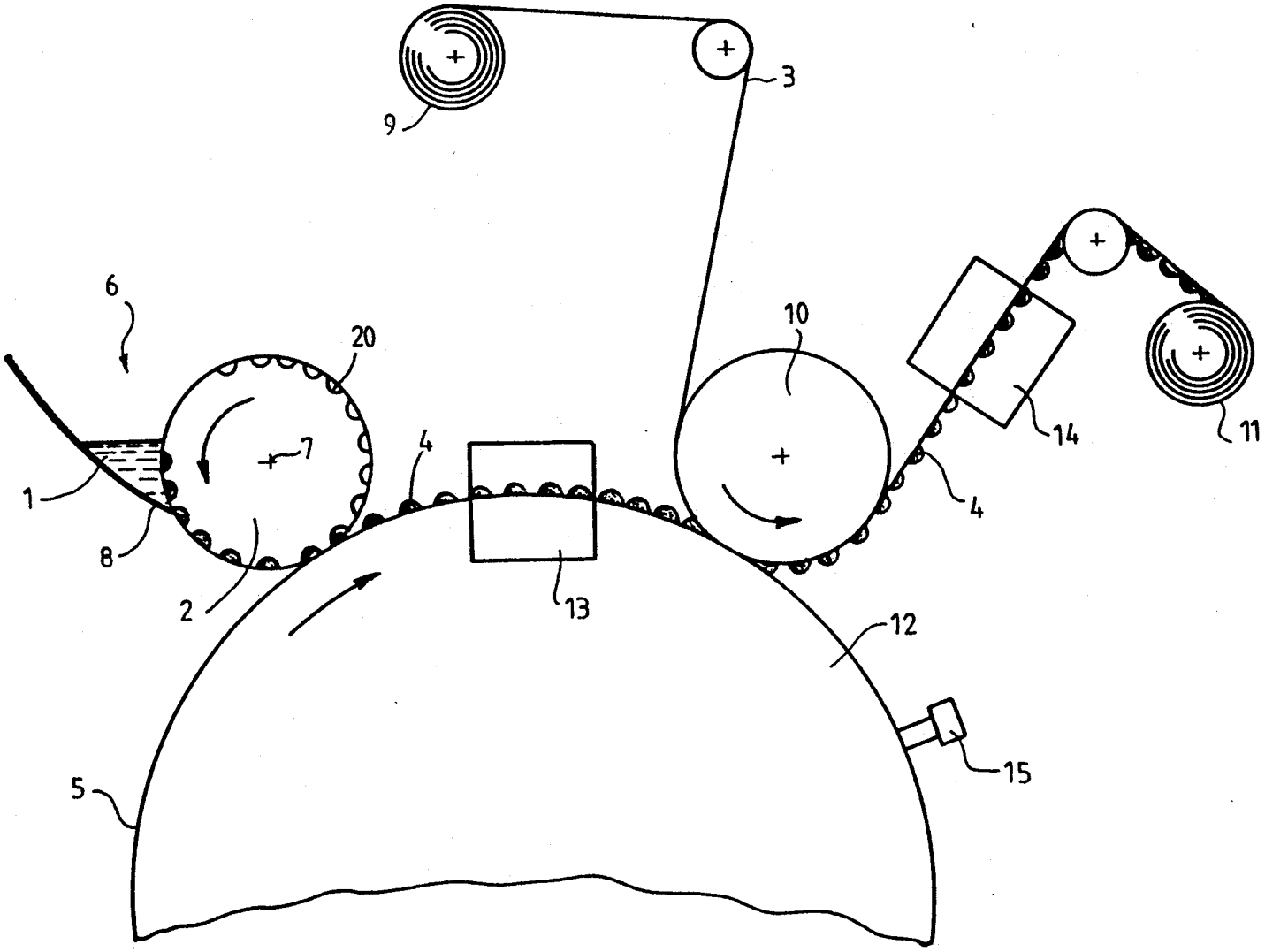
11
14
4
15
12
10
3
13
9
4
20
7
2
6
8
1
5

METHOD AND APPARATUS FOR MANUFACTURING A TEXTILE BASED HEAT-BONDING PRODUCT

The present invention relates to a method of manufacturing a textile based heat-bonding product by hot spot coating.

BACKGROUND OF THE INVENTION

Textile based heat-bonding products are now widely used in the clothing industry and make it possible for example to manufacture linings or reinforcement fabrics which can be heat sealed.

A number of methods and apparatus for manufacturing such products by coating are known.

A first category of methods, called HOT MELT methods, consists in directly applying a molten thermoplastic polymer mass on the textile supporting base. For example, for implementing this method, a polymer mass is brought to a temperature higher than its melting temperature, it is distributed in the cavities of a photogravure cylinder (hollow engraved), the surface of this cylinder is scraped and it is placed in contact with the textile supporting base on which the polymer spots are to be applied.

These methods have a number of drawbacks which have prevented them up to now from developing despite the advantages which they offer.

In fact, this method does not make it possible to obtain quality spot coating. The action of the scraper does not completely eliminate the traces of polymer on the smooth surfaces of the cylinder. Hot polymer residues remain on these surfaces and come into contact with the textile base. In some cases, the textile supporting base, in contact with the photogravure cylinder, loses fibres which adhere to the cylinder, contribute to its clogging up and may even deflect the scraper from the cylinder which produces a continuous adhesive polymer layer which is then deposited on the textile base. The quality of the product obtained is low and ill suited to use in the clothing field.

During use of this method, the polymer mass contained in the cavities, when placed in contact with the textile supporting base, adheres thereto, which contributes to emptying the cavities and depositing of the spots on the textile base. Aerated textiles, or those with gaps or empty spaces, do not provide uniform adherence of the polymer contained in all the cavities. Some of them are then not suitably emptied which leads to coating defects.

A method is further known of manufacturing thermoadhesive textile products in which the adhesive is deposited on the textile base in the form of spots of powder or of aqueous solution. After such deposition, the whole is brought to a high temperature which melts the polymer and causes it to adhere to the textile base.

The patent FR 2 586 717 describes a method of this latter type in which drops of a heat-bonding material dispersion are first of all deposited on an anti-adhesive transfer base; then the drops on the transfer base are heated and the drops of adhesive are placed in contact with the textile base.

SUMMARY OF THE INVENTION

The object of the present invention is a method and apparatus which simultaneously have the advantages of the HOT MELT coating method, among others that of avoiding grinding of the polymers, and the advantages of the transfer method, in particular that of placing the textile in direct contact with the engraved cylinder and avoiding having to bring the textile base to a high temperature.

The method and apparatus of the invention further make possible spot coating having little or no defects, i.e. whose spots are evenly spaced apart and the base is not adhesive outside the spots.

For this, a method is provided for manufacturing a heat-bonding product with a textile base by hot spot coating of the type in which a heat-bonding polymer is brought to melting point, a hot hollow engraved photogravure cylinder is coated with said heat-bonding polymer, and the surface of the cylinder is scraped.

According to the invention, the heat-bonding polymer is deposited in the form of spots on an anti-adhesive transfer mat by the photogravure cylinder and the heat-bonding polymer spots are then placed in contact with the textile supporting base for transfer thereto.

An apparatus is also provided for implementing the above method, comprising means for feeding and heating the heat-bonding polymer, a hollow engraved photogravure cylinder, a scraper and means for receiving the textile based heat-bonding product.

According to the invention, this apparatus comprises an anti-adhesive mat for transferring the heat-bonding polymer spots from the photogravure cylinder to the textile base and permitting partial cooling of the spots.

The invention will be described in greater detail with reference to the drawings in which the single figure shows a general diagram of the apparatus of the invention.

BRIEF DESCRIPTION OF THE DRAWINGS

The FIGURE illustrates schematically an apparatus having means for feeding and heating the heat-bonding polymer, a hollow engraved photogravure cylinder, a scraper, and means for receiving the textile based heat bonding product.

DETAILED DESCRIPTION OF THE PREFERRED EMBODIMENTS

The method of the invention makes it possible to manufacture a textile based heat-bonding product intended particularly for the clothing industry.

This type of product comprises a textile base coated with a heat-bonding polymer.

Spot coating makes it possible to obtain a quality heat-bonding textile which, at the time of its final use after bonding to another textile, provides a flexibility and feel such as sought by ready-to-wear manufacturers.

Good spot coating requires each spot of polymer to adhere to the base and must avoid the deposit of adhesive outside these spots.

After its manufacture, the textile based heat-bonding product is stored at ambient temperature and it is then necessary for the different contacting layers of this product not to adhere to each other.

The method of the invention is of the HOT MELT type, i.e. a heat-bonding polymer 1 is melted then used for filling the cavities 20 of a hollow engraved photogravure cylinder 2.

Up to now, in this type of method, the photogravure cylinder 2 was placed in contact directly with the textile base 3. The temperature of the coating cylinder 2 is then a compromise. It must be sufficiently high to maintain the heat-bonding polymer in the molten state so as not to remain in the cavities of the cylinder and must not be too high so that the molten polymer does not pass through the textile base or damage it.

According to the invention, it has been shown surprisingly that it is possible to dissociate in a first phase the distribution in spots of the adhesive and in a subsequent phase the deposition of these spots on the textile base.

Such dissociation causes simultaneously the dissociation of the above mentioned constraints concerning the temperature of the cylinder 2 and/or of the heat-bonding polymer, by dividing these constraints between the two successive phases. The implementation of the method is then greatly facilitated and makes it possible to obtain satisfactory results.

According to the invention, the heat-bonding polymer 1 is deposited in the form of spots on a transfer mat 5 which is partially anti-adhesive, the spots of heat-bonding polymer 4 are then placed in contact with the textile base 3 for transfer thereto.

The term partially anti-adhesive transfer mat 5 refers in the present description to any surface having this property, i.e. having a low surface tension and coming successively into contact with the photogravure cylinder and the textile base. It has an adhesive strength for the thermoadhesive material lower than that of the textile base.

Its surface is preferably smooth and has neither empty spaces nor roughness.

It must be flexible, made from a glass fibre or aramide fibre structure coated with a polytetrafluoroethylene (PTFE) layer or may be made from silicon coated rubber.

It may also be rigid, for example formed of a metal cylinder coated with a polytetrafluoroethylene (PTFE) layer.

The thermoplastic polymer 1 is brought to melting point. It may for example be a polyamide based mixture softening between 133° C. and 145° C. The photogravure cylinder is brought to a relatively high temperature, for example between 230° and 250° C. At these temperatures, the thermoplastic polymer has a viscosity between 14 and 33 MFI (Multi-Flow Index) which allows the cavities 20 of the photogravure cylinder to be well filled then correctly emptied and so a precise distribution of the heat-bonding polymer to be obtained in the form of spots, i.e. the shape of the spots deposited on the anti-adhesive transfer mat corresponds precisely to the pattern formed by the cavities of the photogravure cylinder; the temperature of the photogravure cylinder 2 is equal to or greater by 0° to 80° C., preferably 20° to 50° C., than the melting temperature of the heat-bonding polymer 1.

The partially anti-adhesive transfer mat 5 is coated with a layer of silicon or polytetrafluoroethylene (TEFLON). It withstands being placed in contact with the photogravure cylinder 2 without difficulty and the temperature of the latter does not risk causing its alteration.

The transfer mat 5 then carries the spots of heat-bonding polymer 4 and places them in contact with the textile base 3.

The temperature of the thermoadhesive polymer spots 4 is controlled between the time when they are deposited by the photogravure cylinder 2 on mat 5 and the time when they are placed in contact with the textile base 3. Such control of the temperature of the polymer spots 4 is either obtained naturally; taking into account the ambient temperature and for a given temperature of the photogravure cylinder, their temperature on arrival depends on their transfer time, or by using means 13 during the transfer of spots 4. The means 13 for controlling the temperature of spots 4 may comprise a heat enclosure or air blower. The temperature of spots 4 will decrease from the photogravure cylinder 2 until they are placed in contact with the textile base 3. At least their upper part, opposite their lower or base part in contact with the transfer mat, must however remain in a molten state so as to permit adherence of spots 4 on the textile base 3.

Generally, when they are placed in contact with the textile base 3, the polymer spots 4 have then a higher viscosity than during their deposit by the photogravure cylinder 2, which prevents these spots 4 from passing through the textile base 3 while making possible their adherence to this base 3. The temperature of the base of spots 4, in contact with the transfer mat 5, is generally slightly less than that on the opposite upper side. This condition of spots 4 is advantageously used. The viscosity of the upper part of the spots which comes into contact with the textile supporting base makes adherence possible and the higher viscosity of the base of spots 4 limits their penetration into the textile base.

During use of a polyamide based adhesive mixture, the polymer may be placed in contact with the textile base when the polymer is at a temperature of about 150° to 160° C. The viscosity of the polymer is then about 25 to 20 MFI (Multi-Flow Index).

By cooling the mat, the base of the spots in contacts therewith is at a lower temperature than at their upper portion.

The textile base 3 is then not brought to a high temperature and so a fragile textile supporting base may be used without danger of damage.

In the method of the invention, numerous polymers widely used in the textile coating field may be used. By way of example the polyesters, polyamides, polyolefins, polypropylenes, plasticized polyvinyl chlorides, thermoplastic polyurethane, polyethylene (high or low density) . . . may be mentioned. These polymers will be used alone or very often mixed with different additives, plasticisers, antioxidants etc. . .

Using these polymers, the temperature of the cylinder has to be greater than the melting temperature of the polymer in order to give to it the required viscosity. Nevertheless the polymer has not to stand the temperature for a long time. Following temperatures have been found to be preferable:

| | |
|---|---|
| Plasticized polyvinyl chlorides | 160–230° C. |
| Thermoplastic polyurethane | 160–200° C. |
| Low density polyurethane | 140–180° C. |
| High density polyurethane | 160–200° C. |
| Polypropylene | 190–230° C. |
| Polyamide | 100–250° C. |
| Polyester | 100–250° C. |

Selecting a polymer its thermal, rheological and physico-chemical properties are to be considered.

Thermal properties

The melting temperature has to be in accordance with the final use of the product: for instance, this temperature is lower than the temperature of presses used by makers when applying the heat bonding product to the garment. It is also higher than the usual temperature of washing or dry cleaning in order that it has no effect on the bonding.

Melting temperature is preferably comprised between 70° and 140° C.

Softening temperature gives both stickness and wettability of the polymer. Stickiness is required during the bonding, and wettability influences the shape taken by the drops when relying on the transfer mat.

When its temperature is raised too high, the polymer can be degraded. Therefore, the degradation temperature should not be exceeded.

Rheological properties

Viscosity of the polymer at various temperatures during the process has to be considered.

At the cylinder temperature it has to be fluid enough to leave the cavities and to be deposited on the mat.

During transfer on the mat it has to be viscous enough not to spread out but to keep spot shape.

When placed in contact with the textile base the polymer has to impregnate the surface fibers in order to grip on while keeping on the surface of the said textile base.

Later on, during bonding of the textile to a garment, the polymer has to be fluid enough to impregnate the fibers of the garment but also viscous enough not to flow through the textile base neither through the garment.

For all these reasons polymers selected have viscosity comprised between:

10 and 150 g/10 mn MFI (Multi-Flow Index) at 200° C., preferably between 20 and 100 and 1 and 25 G/10 mn MFI (Multi-Flow Index) at 130° C., preferably between 1 and 15.

Physico-chemical properties

Physico-chemical properties are concerned with the wettability of the polymer.

Polymers used have an ability to rely on the transfer mat without loosing their spot shape and the dimensions that the cylinder cavities has given to them.

The apparatus of the invention is for implementing the above described method. It comprises means 6 for feeding and heating the heat-bonding polymer 1, a hollow engraved photogravure cylinder 2 rotating about an axis 7, a scraper 8 for collecting the excess adhesive mass deposited on the surface of the photogravure cylinder 2.

It comprises an anti-adhesive transfer mat 5. This transfer mat 5 comprises a surface which prevents adhesion thereon of the polymer which it receives even at the relatively high temperature at which this polymer may be placed in contact with the textile base 5. The fact that the mat is anti-adhesive means then that when spots 4 are placed in contact with the textile base 3, they adhere more strongly to this base than to the transfer mat.

The surface of the transfer mat 5 is coated with a layer of silicon or polytetrafluoroethylene, for example known as TEFLON.

The apparatus preferably comprises means for cleaning mat 5 after spots 4 have been deposited on the textile base 3. The means comprise for example a brush 15 and prevent the fibres which may be deposited by the textile base 3 on the transfer mat 5 from being deposited on the photogravure cylinder 2.

The apparatus comprises means 9 for feeding the textile base, a cylinder 10 for placing the textile base in contact with the spots of heat-bonding polymer and means 11 for receiving the textile based heat-bonding product.

It comprises a cooling zone 14 situated between cylinder 10 and the reception means 11.

Preferably, the anti-adhesive mat 5 is closed on itself which means that it operates in a closed loop and so provides continuous operation of the whole of the apparatus.

In a particularly simple embodiment, the anti-adhesive mat is carried by a cylinder 12.

When the textile base 3 is placed in contact with the heat-bonding polymer spots 4, the distance between this textile base 3 and the anti-adhesive mat 5 is adjusted with precision. It may be adjusted absolutely or in other cases it is the pressure of application of cylinder 10 against the anti-adhesive mat 5 which is adjusted. This or these adjustments optimize the penetration of the heat-bonding polymer spots 4 into the textile base as well as the thickness of these spots after their transfer to base 3.

The method and apparatus of the invention make it possible then to use a HOT MELT coating method in which the phases of distributing the heat-bonding polymer in spots is dissociated from that of depositing these spots on the textile supporting base.

We claim:

1. A method of manufacturing a textile based heat-bonding product, comprising the steps of:

heating a heat-bonding polymer to the melting point of said polymer;

coating said heated polymer onto a photogravure cylinder so that cavities in the surface of said photogravure cylinder contain said polymer, said photogravure cylinder being at a temperature at least as high as the melting temperature of said polymer;

scraping the surface of said cylinder so as to remove at least a portion of any of said polymer which is not in said cavities;

depositing said polymer from said cavities onto a transfer mat, said polymer forming discrete spots on said transfer mat, wherein each of said spots has an upper part and a lower part, and said lower part is in contact with said mat and is cooled by said mat; and contacting said upper part of said cooled spots with the first surface of a textile having first and second opposed surfaces, wherein said spots have a viscosity sufficient to adhere to said first textile surface, but said spots have insufficient viscosity to pass through said textile to said second surface.

2. A method according to claim 1, wherein said spots are cooled on said transfer mat to a temperature beneath that of said cylinder, but remain in a molten state.

3. A method according to claim 1, wherein said spots are cooled on said transfer mat so that said upper part of said spots remain at a temperature higher than the melting temperature of said polymer, and said lower part is at a temperature lower than the melting temperature of said polymer.

4. A method according to claim 1, wherein said polymer has a lower viscosity at the temperature of said cylinder and a higher viscosity when placed in contact with said textile base.

5. An apparatus for producing a heat-bonding product, comprising:

means for heating a heat-bonding polymer to the melting point of said polymer;

a photogravure cylinder provided with heating means to bring the temperature of said cylinder to a temperature at least as high as the melting point of said polymer, said cylinder having cavities in the surface of said cylinder for receiving said polymer;

means for scraping the surface of said cylinder to remove at least a portion of any of said polymer which is applied to said cylinder surface but not received in said cavities;

means for feeding said heated polymer to said surface of said cylinder;

a transfer mat upon which polymer received by said cavities can be deposited in the form of spots;

means for contacting a textile with said spots deposited on said transfer mat; and means for adjusting the temperature of said spots on said transfer mat such that said spots have a viscosity sufficient to adhere to a textile so that said spots when contacted with a textile will be transferred to said textile but said viscosity being insufficient for said polymer to pass through said textile.

6. An apparatus according to claim 5, wherein:

said means for controlling the temperature of said spots will cause the upper part of said spots to be at a higher temperature than the lower part of said spots, said lower part being in contact with said mat.

7. An apparatus according to claim 5, wherein:

said transfer mat is an anti-adhesive mat in the form of a belt which connects to itself, wherein continuous movement of said mat permits continuous transfer of adhesive spots from said cylinder to a textile in conjunction with continuous feeding of heated polymer to and rotation of said cylinder and continuous feeding of a textile to contact said spots.

8. An apparatus according to claim 5, wherein the spacing between said mat and a textile to be contacted with adhesive spots on said mat is adjustable so as to determine the thickness of said adhesive spots on said textile.

* * * * *